United States Patent [19]

Loniello

[11] 4,387,871

[45] Jun. 14, 1983

[54] INSULATING MODULE INCLUDING A HEATER ELEMENT SUPPORT

[75] Inventor: Peter J. Loniello, Watertown, Wis.

[73] Assignee: General Signal Corporation, Stamford, Conn.

[21] Appl. No.: 265,775

[22] Filed: May 21, 1981

Related U.S. Application Data

[62] Division of Ser. No. 931,757, Aug. 7, 1978.

[51] Int. Cl.[3] ..... E21F 17/02

[52] U.S. Cl. ..... 248/58; 219/537

[58] Field of Search ..... 248/58, 317, 59; 373/130; 219/537, 390; 85/3 R

[56] References Cited

U.S. PATENT DOCUMENTS

| | | | |
|---|---|---|---|
| 881,819 | 3/1908 | McIntosh | 411/340 |
| 1,533,264 | 4/1925 | Reid | 373/130 |
| 1,563,743 | 12/1925 | Hazlewood | 411/369 X |
| 1,638,822 | 8/1927 | Biebel | 373/130 |
| 3,259,527 | 7/1966 | Beggs | 373/117 X |
| 3,604,304 | 9/1971 | Botting | 411/343 |
| 3,866,017 | 2/1975 | Keren | 219/390 |
| 4,154,975 | 5/1979 | Sauder | 373/130 |

FOREIGN PATENT DOCUMENTS 254394 12/1948 Switzerland .

*Primary Examiner*—J. Franklin Foss

*Attorney, Agent, or Firm*—Parmelee, Bollinger & Bramblett

[57] ABSTRACT

In a furnace insulating module, a plurality of heating element supports are embedded in situ in a ceramic fiber insulating body. Each support includes a rod with one end embedded in the insulating body. The rod is anchored to the insulating body by means of a cross pin welded to its embedded end. An element supporting keeper at the exposed end of the support rod is pivotable about a transverse pivot axis. The keeper is formed of a pin passing through the rod and bent to form fingers at both ends extending in opposite directions from the pivot axis. When the keeper is in a first position the fingers extend vertically, generally parallel to the support rod, and permit a rod overbend heating element to be moved along the rod to a position above the keeper. With the keeper then moved to a second position with the fingers in a horizontal plane, the heating element may be rested on the keeper fingers and be supported thereby.

5 Claims, 7 Drawing Figures

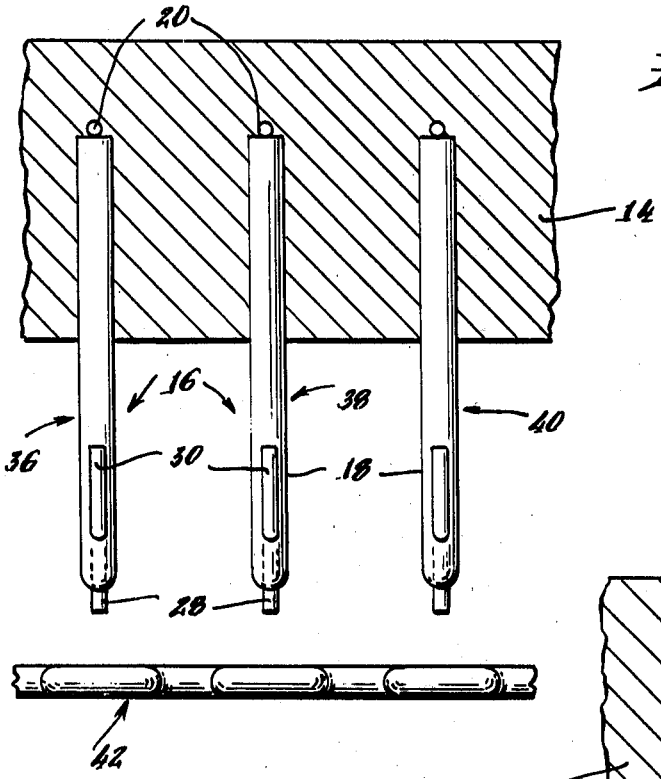
Fig. 5.
Fig. 6.
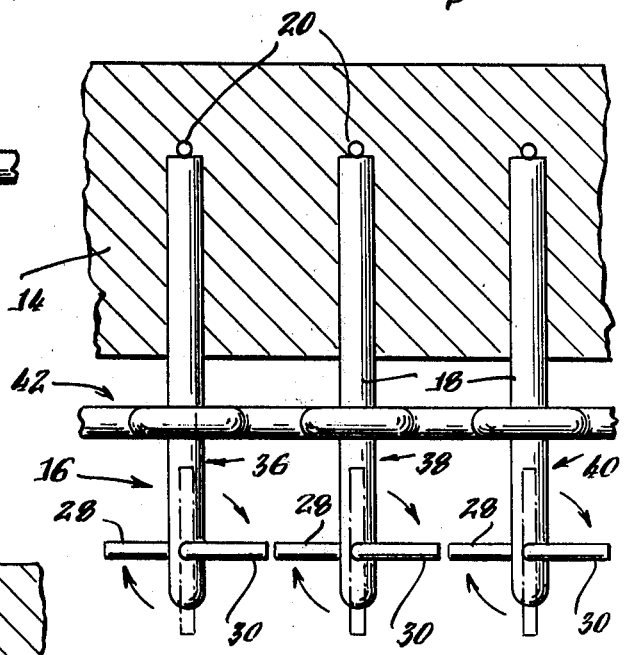
Fig. 7.
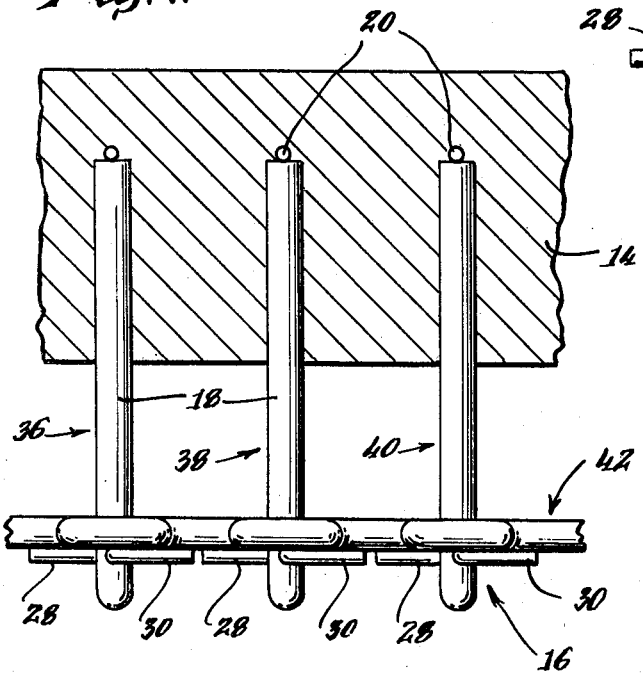

INSULATING MODULE INCLUDING A HEATER ELEMENT SUPPORT

This is a division of application Ser. No. 931,757 filed Aug. 7, 1978.

BACKGROUND OF THE INVENTION

This invention relates to electric furnaces of the type utilizing insulation modules. More particularly, this invention relates to insulation modules to be mounted at the furnace roof and having means to support electric heating elements for the furnace.

In U.S. Pat. No. 3,500,444 to W. K. Hesse, et al, a lightweight ceramic fiber insulation is disclosed. Due to energy saving advantages, such ceramic fiber insulation is often used in place of more dense fire brick for furnace linings. Many of the insulation applications are for oil or gas fired furnaces. However, such insulation may also be used with electric heating elements as shown in the Hesse, et al patent and in the Werych U.S. Pat. No. 3,870,861. In those patents electric heating coils are embedded in the ceramic fiber.

An often preferred form of electric heating element for use in furnaces is that which has become known as the rod overbend type of heating element. Such a heating element is formed of a single, substantially rigid rod suitable for conducting electricity and thereby becoming heated. To form an overbend element, a rod is bent around forming rods into successive parallel passes of a heating element. An example of such a rod overbend heating element is shown at 42 in FIG. 4. Although named for the specific preferred method of forming the successive pass configuration of the rod overbend element, the element may be formed by any of a number of other methods.

With the increased use of ceramic fiber insulating modules to insulate the roofs as well as walls of furnaces, it has become desirable to provide appropriate means for supporting a rod overbend element below a ceramic fiber furnace roof. An object of this invention is to provide such a heating element support, especially one which is structurally simple yet quite durable.

It is a further object of this invention to provide such a heating element support which provides for quick mounting and quick release of rod overbend heating elements so that the heating elements may readily be replaced as necessary without damaging the furnace.

SUMMARY

In a preferred embodiment of the invention to be described, an insulating module includes an insulating body and a plurality of support rods. One end of each support rod is embedded in and anchored to the insulating body, and the other end of each rod extends outwardly from a surface of the insulating body. An element-supporting keeper is pivotable about a transverse pivot axis near the exposed end of each support rod. Each keeper includes fingers extending in opposite directions from the transverse pivot axis. In one position of the keeper the fingers extend generally parallel to the support rod to permit a heating element to be moved into or out of place relative to the insulating module. In a second position of the keeper, the fingers extend transverse to the support rod between successive passes of a rod overbend heating element to thereby engage and suspend the heating element below the insulating body.

According to the invention in another of its aspects, the keeper comprises a pin extending through the support rod. End portions of the pin are angled in opposite directions to form support fingers.

In accordance with another aspect of the invention, the support rod is anchored to the insulating body by a cross pin fixed to the embedded end of the support rod.

A rod overbend heating element may be supported in the keeper by placing the keeper in its vertical position, raising the heating element along the support rod to a position above the keeper, and then pivoting the keeper to its horizontal position. The heating element may then be rested on the fingers of the keeper.

BRIEF DESCRIPTION OF THE DRAWINGS

The foregoing and other objects, aspects, and advantages of the invention will be apparent from the following detailed description of a preferred embodiment of the invention, considered together with the accompanying drawings in which like reference characters refer to the same parts throughout the different views. The drawings are not necessarily to scale, emphasis instead being placed upon illustrating the principles of the invention. In the drawings:

FIG. 5 is a side view of three element supports embedded in an insulating body with the respective keepers in their vertical positions for receiving a heating element;

FIG. 6 is a side view of the supports and heating element of FIG. 5 with the heating element in a raised position above the keepers, and the keepers rotated to their horizontal positions;

FIG. 7 is a side view similar to FIG. 6 but with the heating element resting on the keepers.

DESCRIPTION OF A PREFERRED EMBODIMENT

Figure 1:
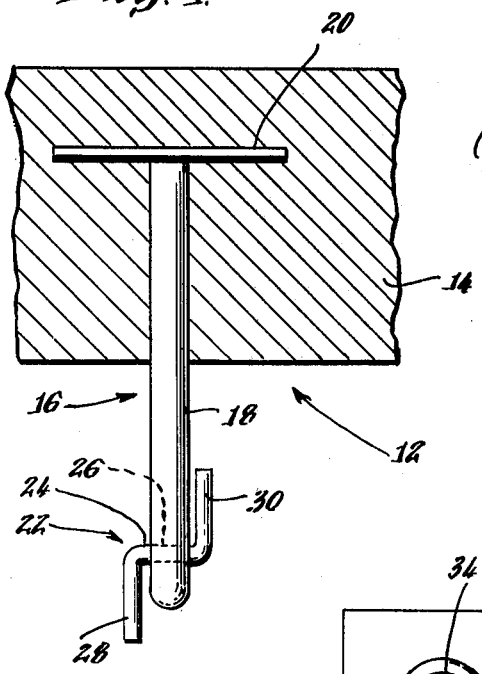
FIG. 1 is a front view of a heating element support shown embedded in an insulating body.

Referring now to FIG. 1, there is shown a section of an insulating module comprising a ceramic fiber insulating body 14 which is sectioned in the drawing to show embedded in its interior an element support generally indicated at 16. The support 16 includes a vertical support rod 18, one end of which is located within the insulating body 14, and securely held therein. The anchoring of the rod 18 within the insulating body is enhanced by a cross pin 20 welded to the embedded end of the rod.

At the exposed end of the rod 18, an element supporting keeper 22 is pivotably mounted on the rod. The keeper 22 is a pin including a central pivot portion 24 extending along a transverse pivot axis through a hole 26 in the support rod. End portions 28 and 30 of the pin are bent relative to the central pivot portion. The bent end portions form fingers extending in opposite directions from the transverse pivot axis. The two fingers of each support are in a common plane, together with the pivot portion 24.

In one method for forming the assembly of the keeper 22 and rod 18, the keeper pin first is heated and bent at one end to form one finger 28. Then the straight end is inserted through the hole 26, heated, and bent to form the other finger 30.

The insulating body preferably is of the type disclosed in U.S. Pat. No. 3,500,444. As disclosed in that patent, ceramic fibers may be combined in a slurry with a liquid binder. When the liquid is drawn from a mold as by suction, a hard, molded ceramic fiber body remains. In accordance with this invention, during the ceramic fiber molding process several supports 16 are inverted and suspended at a proper level within the mold. Then, the slurry is poured into the mold and the slurry encapsulates the ends of the supports having cross pins 20. When the liquid is then drawn from the slurry, the supports remain embedded in the ceramic fiber body.

Figure 2:
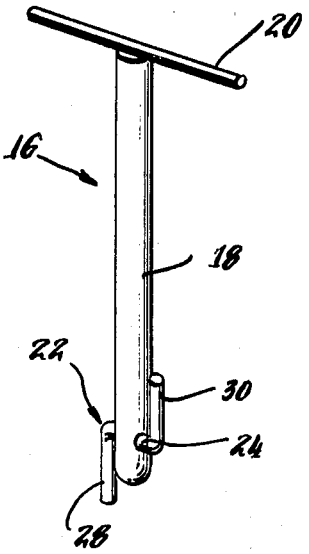
FIG. 2 is a perspective view of an element support with the keeper in its vertical position.
Figure 3:
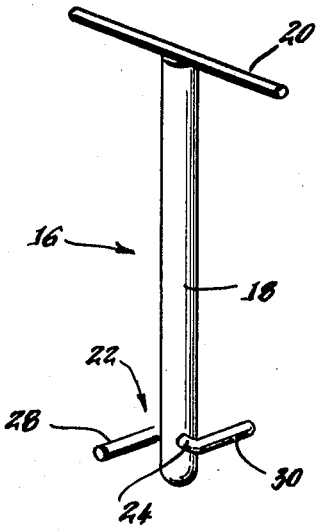
FIG. 3 is a perspective view of the support of FIG. 2 but with the keeper in its horizontal position.

FIGS. 2 and 3 show an element support with the keeper 22 in a first vertical position (FIG. 2) and in a second horizontal position (FIG. 3). The keeper is freely rotatable about the central pivot portion 24, but, as will be discussed below, the weight of an engaged heating element holds the keeper in the second position of FIG. 3 when the heating element is rested on the fingers 28 and 30.

Figure 4:
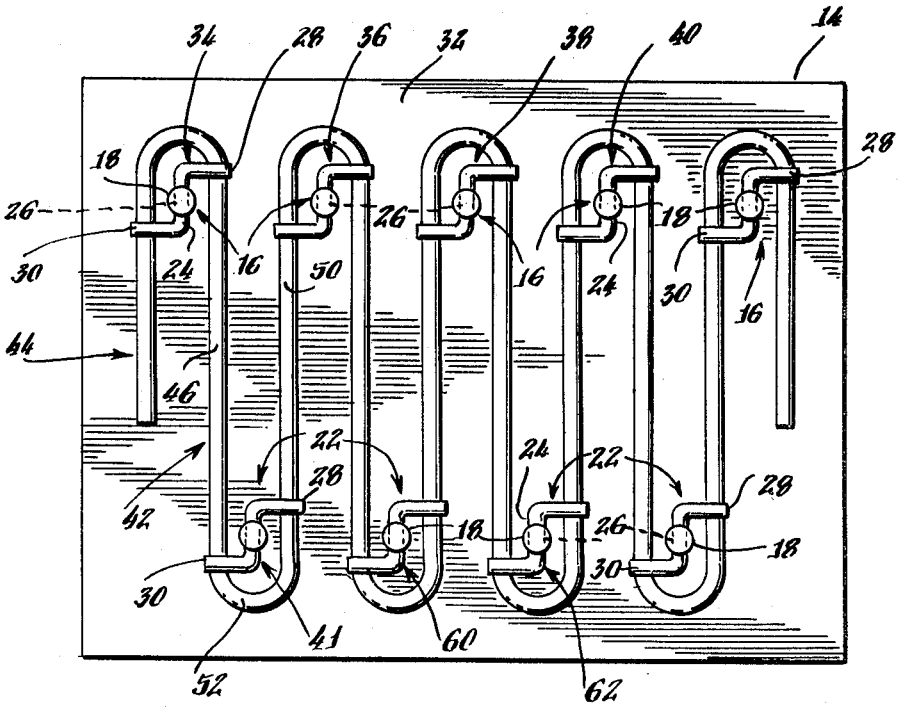
FIG. 4 is a bottom plan view of an insulating module with a plurality of supports suspending a rod overbend heating element.

As shown in FIG. 4, the insulating body 14 has a rectangular lower surface 40. Although not shown as such, the insulating body may be shaped to interfit with other insulating bodies in a tongue and groove or shiplap fashion to complete a furnace roof. A plurality of element supports 16 (in this case nine) extend downwardly from the lower surface 40 of the insulating body. A rod overbend heating element 42 rests on fingers 28, 30 of respective keepers. The rod overbend heating element 42 includes a series of parallel passes, such as 44, 46 and 50, of a rigid electric heating rod. The passes are joined by bend portions such as 48, 52 and 54.

The sequence of moving the rod overbend heating element 42 into its supported position is illustrated by FIGS. 5 through 7. In FIG. 5 each of the keepers is in its vertical position with fingers 28, 30 generally parallel to each support rod 18. A heating element 42 is shown in a ready position below the supports with the parallel passes of the element directed into the page. In these views, for clarity only the element supports 36, 38 and 40 adjacent bend portions 54, 56 and 58 are shown. Additional supports 60 and 62 would also be seen behind and staggered relative to those supports.

The heating element 42 is moved upwardly with pairs of passes straddling each support rod. Then, with the heating element held above the keepers, the keepers are rotated to the horizontal positions shown in FIG. 6. Finally, the heating element is lowered so that respective passes of the heating element rest on oppositely directed fingers of each keeper (FIG. 7).

The keepers are retained in their horizontal positions by the weight of the heating element. As can be seen from FIGS. 6 and 7, if any keeper were to pivot from its horizontal position, one of the fingers 28, 30 would move upwardly from the horizontal plane. However, in that event the weight of the adjacent pass of the heating element would press down against that finger to stop it from moving up. Thus, by preventing either finger from pivoting upwardly, the weight of the heating element holds the fingers in the horizontal plane.

With the heating element resting on the keepers, the support rods 18 block lateral movement of the heating element which could result in the element slipping off the fingers. For example, if, due to vibrations or the like, the heating element 42 were to move toward the top of the drawing of FIG. 4, bend portions of the element such as bend portion 52 would be stopped by adjacent support rods such as that of support 41. Similarly, if the heating element were to move down in the drawing of FIG. 4, support rods such as those in supports 34 and 36 would interrupt movement. Finally, with respect to leftward or rightward movement of the heating element, the fingers 28 and 30 are made sufficiently long that the passes of the heating element would engage the support rods before the heating element slipped off the ends of the fingers.

From the above description of a preferred embodiment of the invention, it will be apparent that a heating element may be held in place in a secure fashion by the support structure disclosed herein. Moreover, the heating element can easily be released for removal, as for servicing or replacement. This can be done by first lifting the heating element well above the keepers, and then moving the keepers to their vertical positions. The heating element then can be shifted downwardly past the keepers, and repaired or replaced without any damage to the insulating module.

While the invention has been particularly shown and described with reference to a preferred embodiment thereof, it will be understood by those skilled in the art that various changes in form and details may be made therein without departing from the spirit and scope of the invention as expressed by the appended claims.

What is claimed is:

1. A method of supporting a rod overbend heating element from an insulated roof, comprising the steps of:

forming an insulating body with a plurality of support rods extending outwardly therefrom and with each of said support rods having an element-supporting keeper associated therewith which is rotatable between first and second positions about an axis transverse to said support rod, each of said keepers being formed with fingers extending in opposite directions from said transverse axis with said fingers lying in a vertical plane when said keeper is in its first position and lying in a horizontal plane when said keeper is in its second position;

placing said keeper in its first vertical position;

moving said heating element towards said body with sections of the element straddling said support rods until the heating element has reached a position between the keepers and the body;

placing the keepers in their second positions; and resting the heating element on the fingers of the keepers.

2. A method of supporting rod overbend heating elements as claimed in claim 1 wherein said element support keeper comprises a pin extending through a hole in said support rod, said pin being bent to form said oppositely directed fingers.

3. A method of supporting a rod overbend heating element from an insulated roof, comprising the steps of:

forming an insulating body with a plurality of support rods extending outwardly therefrom and with each of said support rods having an element-supporting keeper associated therewith which is rotatable between first and second positions about an axis transverse to said support rod, each of said keepers being formed with at least one finger extending transversely with respect to the rod axis when in said second position and angularly rotated therefrom when in said first position;

placing said keeper in its first position;

moving said heating element towards said body with sections of the element straddling said support rods until the heating element has reached a position between the keepers and said body;

placing the keepers in their second positions transverse to the rod axes; and moving the heating element down into contact with said fingers of said keepers to thereby effect support for the heating element.

4. A method of supporting rod overbend heating elements as claimed in claim 3, wherein in said first position said keepers are parallel to the rod axes.

5. A method of supporting rod overbend heating elements as claimed in claim 4, wherein said keepers each comprise a pair of fingers extending in opposite directions away from the axis of rotation.

* * * * *